US007833139B1

(12) United States Patent
Endelman et al.

(10) Patent No.: US 7,833,139 B1
(45) Date of Patent: Nov. 16, 2010

(54) DETACHABLE PULLEY ASSEMBLY

(75) Inventors: Ken Endelman, Sacramento, CA (US); Brian Masterson, Placerville, CA (US)

(73) Assignee: Balanced Body, Inc., Sacramento, CA (US)

( * ) Notice: Subject to any disclaimer, the term of this patent is extended or adjusted under 35 U.S.C. 154(b) by 23 days.

(21) Appl. No.: 12/496,312

(22) Filed: Jul. 1, 2009

(51) Int. Cl.
*A63B 21/02* (2006.01)

(52) U.S. Cl. ..... 482/123; 482/132; 482/135; 254/414

(58) Field of Classification Search ..... 482/72, 482/95, 96, 123, 126, 128–130, 132, 133, 482/135, 140; 242/615.1, 615.2, 615.3; 254/390, 254/391, 409, 410, 413, 414, 415, 392; 474/113, 474/117, 136, 138; D8/360
See application file for complete search history.

(56) References Cited

U.S. PATENT DOCUMENTS

| | | | | | |
|---|---|---|---|---|---|
| 21,602 | A * | 9/1858 | Focht | 254/415 |
| 210,281 | A * | 11/1878 | Weston | 188/64 |
| 862,647 | A * | 8/1907 | Macdonald | 254/409 |
| 2,266,196 | A * | 12/1941 | Haniquet | 254/273 |
| 2,716,027 | A * | 8/1955 | Gehri | 482/131 |
| 3,112,103 | A * | 11/1963 | Falkenberg | 267/71 |
| 3,945,264 | A * | 3/1976 | Falkenberg | 474/138 |
| 4,119,300 | A * | 10/1978 | Goudey | 254/391 |
| 4,125,257 | A | 11/1978 | Lew | |
| 4,160,541 | A * | 7/1979 | Harken et al. | 254/395 |
| 4,561,651 | A | 12/1985 | Hole | |
| 4,667,625 | A * | 5/1987 | Malone | 119/785 |
| 5,176,599 | A * | 1/1993 | Beliakov | 482/91 |
| 5,530,991 | A * | 7/1996 | deNormand et al. | 16/198 |
| 6,142,919 | A | 11/2000 | Jorgensen | |
| 6,485,207 | B1 * | 11/2002 | Allen et al. | 400/335 |
| 7,114,544 | B2 * | 10/2006 | Rice et al. | 160/178.1 V |
| 7,674,211 | B2 * | 3/2010 | Uygan | 482/123 |
| 2008/0171643 | A1 * | 7/2008 | Baudhuin | 482/148 |

* cited by examiner

*Primary Examiner*—Loan Thanh
*Assistant Examiner*—Daniel F Roland
(74) *Attorney, Agent, or Firm*—Greenberg Traurig, LLP

(57) ABSTRACT

A pulley assembly for removably fastening an arm cord to an exercise apparatus is disclosed. The pulley assembly includes a yoke having a central portion and a pair of parallel leg portions, the central portion having a bore therethrough, a pulley wheel rotatably supported between the yoke leg portions by an axle, and an elongated stem having an axially extending shaft portion protruding through the bore. The shaft portion has distal end portion having an L shaped slot formed therethrough. The L shaped slot forms a hook shaped end to the shaft portion. A tapered coil spring over the shaft portion of the stem, has a small end and a large diameter around the shaft portion of the stem. The spring biases the hooked end away from an eyebolt on the exercise apparatus to keep the pulley assembly engaged with the eye bolt and hence fastened to the exercise apparatus.

8 Claims, 4 Drawing Sheets

DETACHABLE PULLEY ASSEMBLY

BACKGROUND OF THE DISCLOSURE

1. Field of the Disclosure

The present disclosure relates to pulleys. In particular, it relates to a pulley assembly utilized in physical exercise apparatus.

2. State of the Art

Exercise machines such as reformers utilized in the performance of physical exercises originated by Joseph Pilates often employ pulleys through which cords are extended. One end of each of such a cord is typically attached to a spring biased carriage and the other end attached to a grip loop or handle. The pulley is in turn fastened to one end of the reformer or may be attached to an upright member extending from the frame of the reformer. The pulley is typically bolted to the upright member or may be adjustably fastened to the upright member through a slot in the upright member. Such installations of pulleys are relatively permanent, as they are fairly difficult to remove, requiring the pulley to be unbolted from the upright to which it is attached. Therefore, if many alternative pulley locations are desired to be used, either additional pulleys must be mounted on the upright members or changing them requires a substantial amount of time to complete.

SUMMARY OF THE DISCLOSURE

A removable pulley assembly for use in an exercise apparatus such as a reformer is disclosed which permits the pulley to be attached to any appropriately sized device such as an eyebolt or hook. The removable pulley assembly preferably includes a yoke having a central portion and a pair of parallel leg portions. The central portion has a bore therethrough, and a pulley wheel is rotatably supported between the yoke leg portions by an axle. An elongated stem having an axially extending shaft portion protrudes through the bore. The shaft portion has a distal end portion having an L shaped slot formed therethrough. The L shaped slot forms a hook shaped end to the shaft portion of the stem. A tapered coil spring over the shaft portion of the stem has a small end wrapped onto the shaft portion and a large diameter around the shaft portion of the stem. The hooked end can be hooked onto an eyebolt. The spring biases the hooked end away from the eyebolt on the exercise apparatus to keep the pulley assembly engaged with the eye bolt and hence fastened to the exercise apparatus.

In a preferred embodiment, the pulley assembly is for removably fastening an exercise cord to an exercise apparatus. The pulley assembly comprises a yoke having a central portion and a pair of parallel leg portions, the central portion having a bore therethrough. A pulley wheel is rotatably supported between the yoke leg portions by an axle. An elongated stem having an axially extending shaft portion protrudes through the bore. The shaft portion has a distal end portion having an L shaped slot formed therethrough with an axial portion and a radial portion. The radial portion opens through the side of the shaft portion. The axial portion terminates short of the end of the shaft portion, forming a hook shaped end to the shaft portion. The assembly also has a tapered coil spring over the shaft portion of the stem having a small end and a large diameter end, wherein the small end is wrapped around the shaft portion of the stem.

BRIEF DESCRIPTION OF THE DRAWINGS

The disclosure will be better understood and objects, other than those set forth above, will become apparent when consideration is given to the following detailed description. Such description makes reference to the accompanying drawings wherein.

DETAILED DESCRIPTION

In the following description, numerous specific details are set forth in order to provide a more thorough disclosure. It will be apparent, however, to one skilled in the art, that the art disclosed may be practiced without these specific details. In some instances, well-known features may have not been described in detail so as not to obscure the art disclosed.

Figure 1:
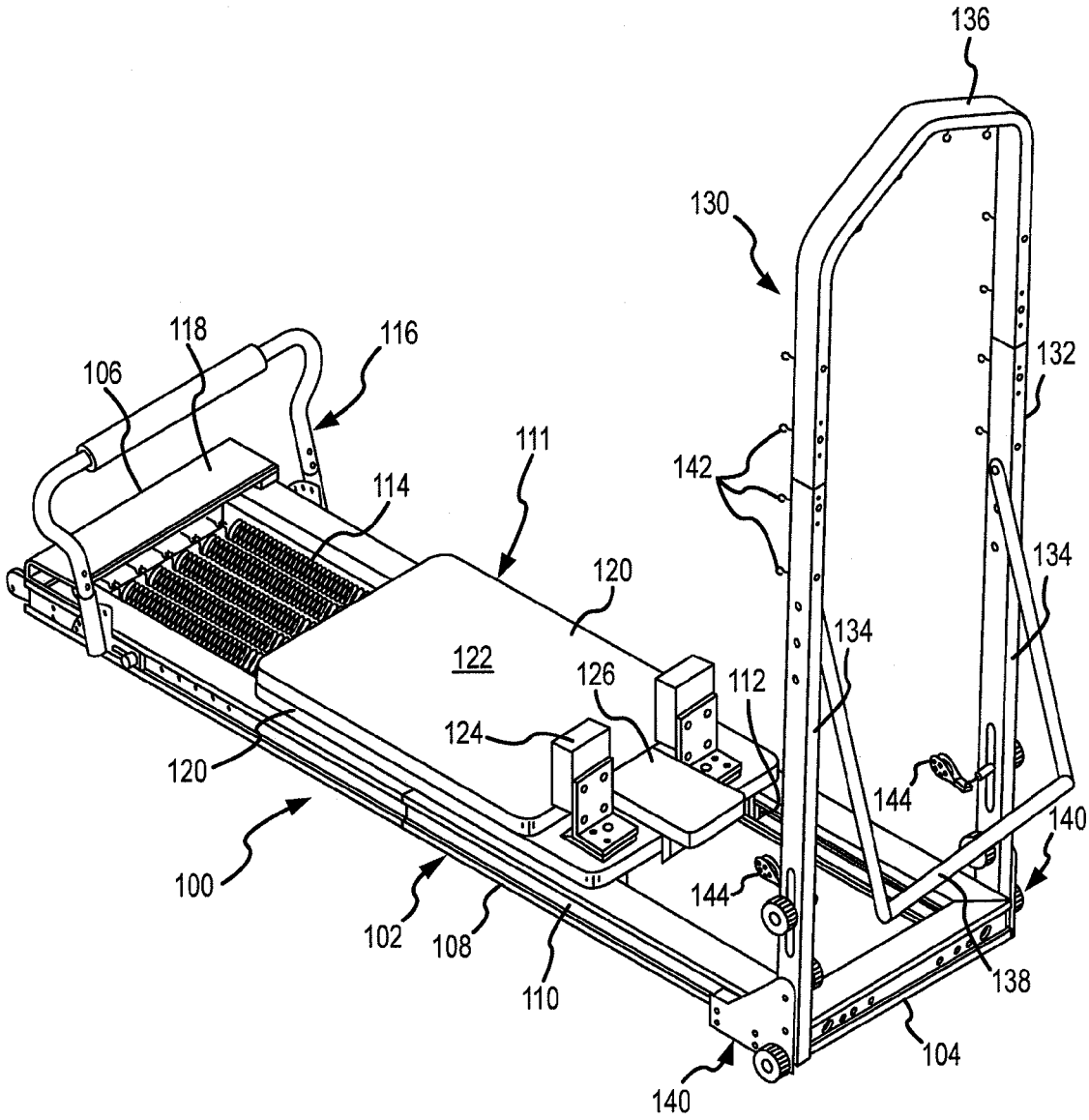
FIG. 1 is a perspective view of a reformer exercise apparatus incorporating one or more pulley assemblies in accordance with the present disclosure.

A perspective view of a reformer apparatus 100 is shown in FIG. 1. This particular reformer 100 has a trapeze assembly 130 installed at its head end. The exercise apparatus 100 comprises a generally rectangular frame 102 having a head end 104 and a foot end 106 and a pair of parallel track or rail members 108 separating the head end 104 from the foot end 106. Each of the rail members 108 has an outwardly open T shaped slot 110 running the length of each of the rail members 108. A movable carriage 111 rides on four roller/guide wheel assemblies 112, one of which can barely be seen in FIG. 1, fastened to the underside of the carriage 111. These wheel assemblies 112 roll on the track members 108 to support and guide movement of the carriage 111 back and forth along the track members 108 of the frame 102. A plurality of elastic members, e.g., springs 114 are selectively connected between the carriage 111 and the foot end 106 to bias the carriage 111 toward the foot end 106.

A foot bar assembly 116 is removably fastened to the frame 102 near the foot end 106 so as to provide a stationary support for a user of the apparatus 100 to push against while reclining or sitting on the carriage 111 in order to move the carriage 111 back and forth along the track members 108. The foot end 106 also includes a flat foot topped foot platform 118 for a user to place one foot on while the other foot is placed on the carriage 111 for standing exercises on the apparatus 100.

The head end 104 is designed to space the rail members 108 rigidly apart. The head end 104 is preferably a rectangular box tubular extrusion member made preferably of aluminum fastened to the head ends of the rail members 108.

The carriage 111 comprises a flat support platform 120 which has a generally rectangular shape. A cushion pad 122 is secured to an upper surface of the platform 120. A pair of shoulder stops 124 are spaced apart near one end of and fastened to the rectangular platform 120. These shoulder stops 124 engage with a user's shoulders when the user lies on his or her back on the carriage 111 while exercising on the apparatus 100. A padded headrest 126 is fastened via a hinge at a base end to the platform 120 between the shoulder stops 124.

A trapeze assembly 130 is slidably installed in the T shaped slots 110 in the rails 108. The trapeze assembly 130 includes an upside down U shaped or arched frame 132 that has two parallel legs 134 joined by a U shaped upper section 136, typically has a trapeze bar 138 suspended from the legs 134, and has a pair of support bracket assemblies 140 that slide into the T shaped slots 110 in the rails 108. These support bracket assemblies 140 permit the trapeze frame 132 to be rigidly positioned in an upright operating position at the head end 104 of the frame 102 as shown in FIG. 1.

The trapeze frame 132 has adjustable exercise cord pulleys 144 adjustably attached to the vertical frame legs 134 of the trapeze frame 132. These permit a user to attach one end of an exercise cord (not shown) to the reformer carriage 111 and pass, the other end through the pulley 144 to a hand grip to then perform resistance based exercises via the user's arms or legs, while standing, sitting or reclining on the carriage 111.

There are also a number of eyebolts 142 fastened at various heights on the trapeze frame members 134 from the reformer head end 104. A spring (not shown) may be attached to one or more of these eyebolts to facilitate various additional exercise regimens. Alternatively springs may be attached to the trapeze bar 138 and thence to one of the eyebolts 142 to provide a resilient bias to the trapeze bar for other exercise purposes.

One or more pulleys 200 in accordance with the present disclosure may be removably attached to the reformer 100 via one of these eyebolts 142. This permits a user to extend exercise cords from the carriage 111, through a set of pulleys located at the head end 104 in general alignment with the carriage 111, such as pulleys 144 in a lowered position, and through one or more of the pulleys 200 to facilitate additional exercise routines which otherwise could not be performed, such as an exercise performed while standing on the carriage 111. These alternative locations permit a wide variety of alternative exercises to be performed without the need for a large number of pulleys such as pulleys 144, and without the need for restringing the cords through new pulleys each time a pulley location is changed. Instead, the pulley 200 may be simply relocated to another eyebolt 142.

While eyebolts 142 are shown attached to the trapeze frame 132, other locations for eyebolts 142 may also be utilized. For example, eyebolts 142 could be provided at corners of the trapeze bar 138, on the foot bar assembly 116, or on other locations of the frame 102 of the reformer 100. Thus the eyebolt locations shown in FIG. 1 are purely exemplary.

Figure 2:
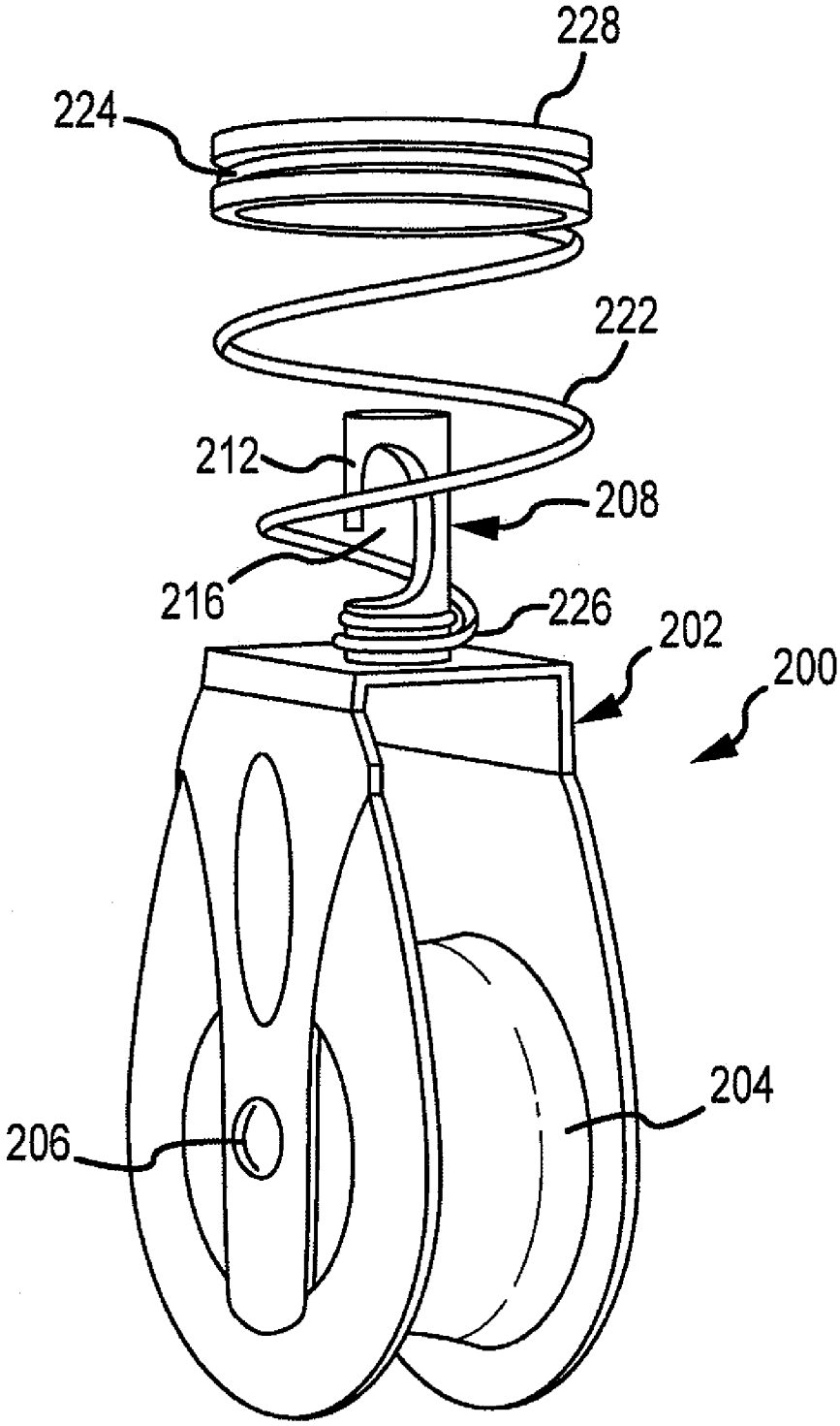
FIG. 2 is a separate perspective view of an exemplary embodiment of a pulley assembly in accordance with the present disclosure.
Figure 3:
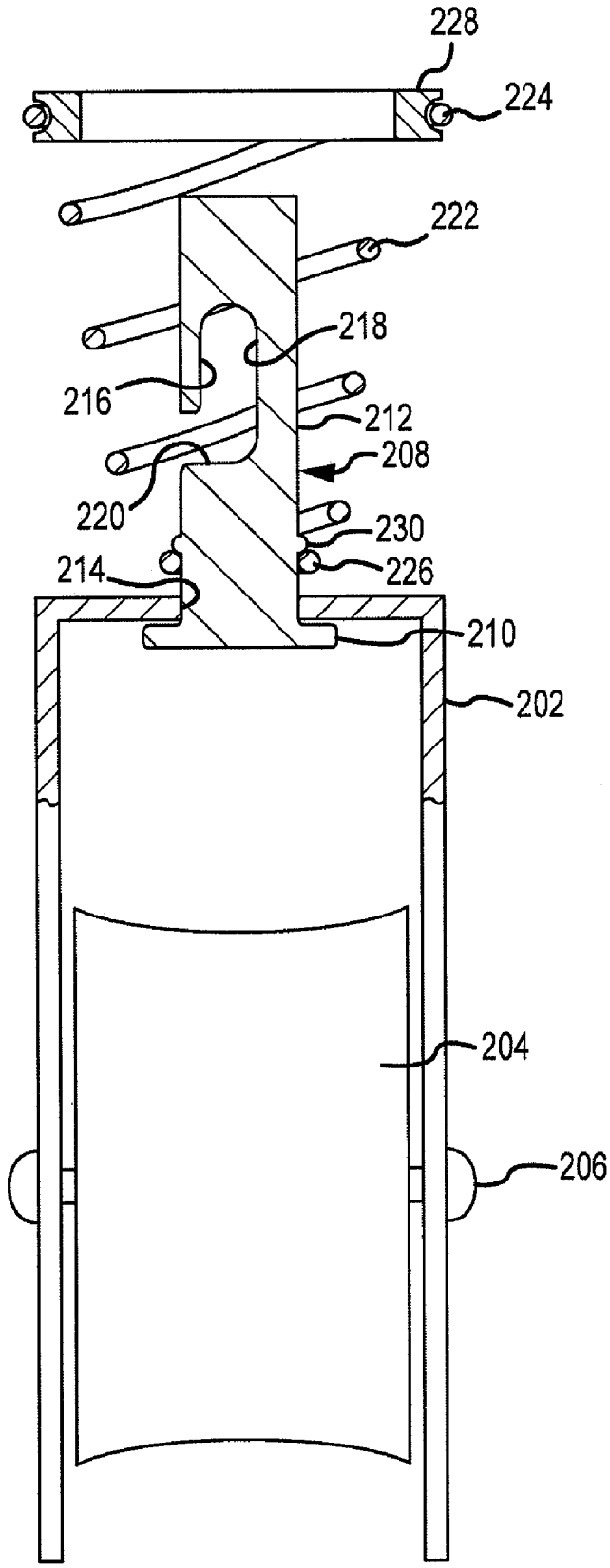
FIG. 3 is an axial cross sectional view of the pulley assembly shown in FIG. 2.
Figure 4:
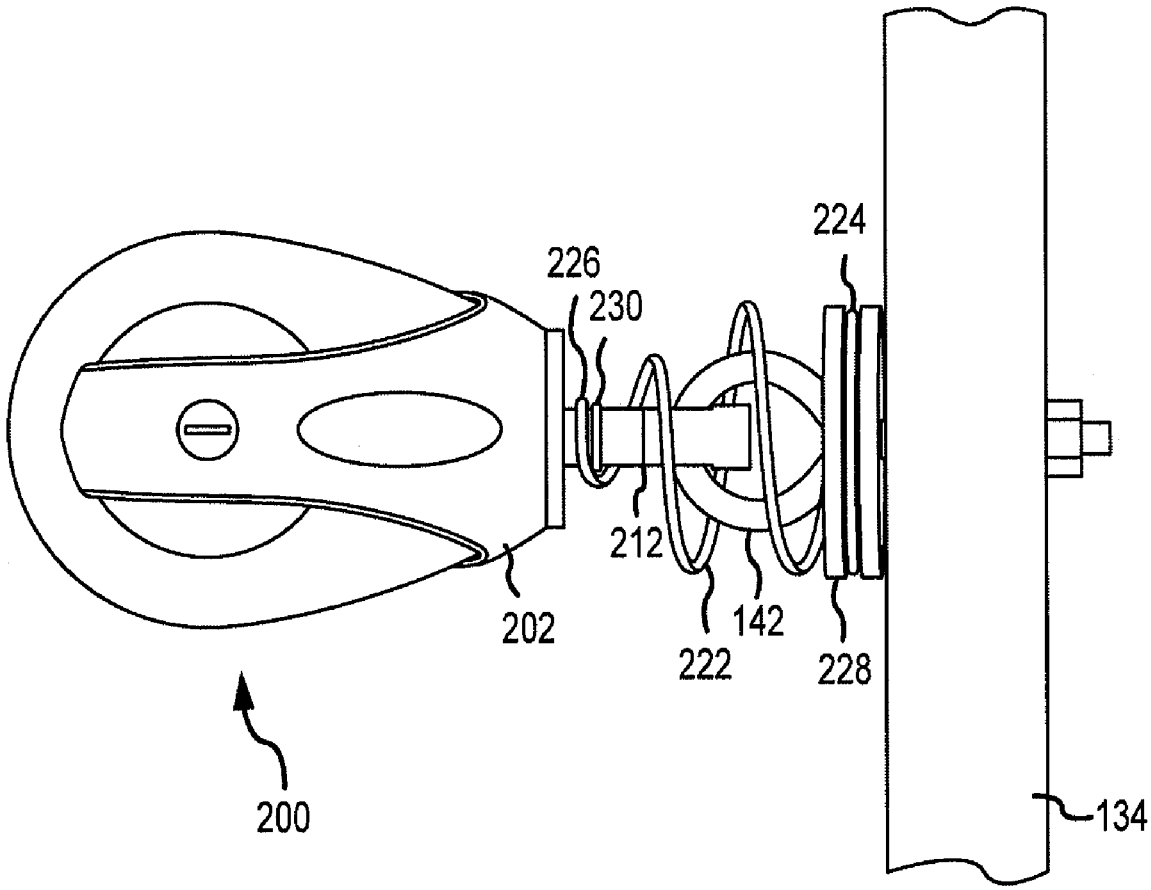
FIG. 4 is a side view of the pulley assembly shown in FIG. 2 attached to an eyebolt secured to an upright frame member of the reformer exercise apparatus shown in FIG. 1.

An enlarged perspective view of one embodiment of a detachable pulley assembly 200 in accordance with this disclosure is separately shown in FIG. 2. A cross sectional view of this pulley assembly 200 is shown in FIG. 3. FIG. 4 shows the pulley assembly 200 attached to one of the eyebolts 142 on the trapeze frame 132.

The pulley assembly 200 for use on an exercise apparatus such as a reformer 100 includes a yoke 202 supporting a pulley wheel 204 on an axle 206, a stem 208 having a head portion 210 and a cylindrical elongated shaft portion 212 protruding through a central hole or bore 214 through the yoke 202. The head portion 210 of the stem 208 is larger in diameter than the shaft portion 212 such that the stem 208 passes through and is retained in the bore 214 through the yoke 202. The stem 208 may be prevented from being withdrawn from the central bore 214 by interference with the pulley wheel 204, rib 230, or other obstruction to removal. A distal end of the shaft portion 212 has a hook shape formed by an elongated L-shaped slot 216 cut completely through the shaft portion 212. The slot 216 has an axial portion 218 that extends along the axis of the shaft portion and a radial portion 220 that cuts through the periphery of the shaft portion 212 to the center of the shaft portion 212. Together the axial portion 218 and radial portion 220 essentially form a distal end hook on the stem 208. The axial portion 218 of the slot 216 extends axially along the shaft portion 212 and ends just short of the end of the shaft portion 212 to form the hook shape. The pulley assembly 200 also includes a tapered coil spring 222 around the stem 208 that has a large diameter end 224 and a small diameter end 226. The small diameter end 226 is wrapped around and is fastened to the shaft portion 212. The large end 224 wraps around and captures a grommet or bushing 228. The bushing 228 is preferably made of a flexible material such as an elastomeric material, leather or fabric, although rigid materials such as a rigid plastic or metal may alternatively be used to form the bushing.

This bushing 228 is sized to fit over and receive the eye of one of the eyebolts 142 therein. The spring 222 is compressed to permit the hook shaped distal end of the stem 208 to hook through the eye of the eyebolt 142. The spring 222 then pushes the stem 208, away from the eyebolt 142 to elastically retain the stem 208, and hence the pulley assembly 200, firmly engaged with the eyebolt 142 at the end of the axial slot 218 in the shaft portion 212. In this manner the assembly 200 is firmly attached to whatever structure the eyebolt 142 is fastened to. Yet the pulley assembly 200 may be quickly removed from the eyebolt 142 by pressing the stem 208 against spring pressure to unhook the shaft portion 212 from the slot 216.

The stem 208 is preferably made of a high tensile strength material such as steel, titanium or a high strength metal alloy. The shaft portion 212 of the stem 208 in the assembly 200 also preferably has an annular flange or rib 230 around the shaft portion 212 spaced from the yoke 202. An equivalent to this rib 230 could alternatively be a snap ring (not shown) in a complementary groove formed around the shaft portion 212. The small diameter end 226 of the spring 222 fastens to the shaft portion 212 between the rib 230 and the yoke 202 to retain the spring 222 on the stem 208 when the assembly 200 is disengaged from an eyebolt 142. The assembly 200 remains together as an assembly by virtue of the narrow end of the spring 222 being captured between the rib 230 and the yoke 202.

At the same time, when the pulley assembly 200 is installed on an eyebolt 142 fastened to the frame 132, compression of the spring 222 against the frame 132 biases the stem 208 away from the eyebolt 142 to maintain engagement of the shaft portion 212 with the eyebolt 142 and prevent the shaft portion 212 from disengaging the slot 216.

To install a pulley assembly 200, a user compresses the coil spring 222 against the surface to which the eyebolt 142 is fastened and the hooked distal end of the stem 208 is passed beside the eye of the eyebolt 142 such that the eyebolt 142 is inserted into the slot 216 in a manner such that as compression force on the spring is relaxed, the eyebolt remains in slot 216 and rests at the distal end of stem 208. This spring bias between the support surface and the stem 208 keeps the pulley assembly 200 fully engaged with and attached to the eyebolt 142 until such time as a user desires to relocate the pulley assembly 200.

Removal of the pulley assembly 200 is essentially the reverse. The user pushes the assembly 200 toward the frame 132 to which the eyebolt 142 is attached, until the stem 208 can be unhooked from the eyebolt 142. Once released from the eye, spring forces simply permit the spring 222 to return to its uncompressed state. The spring 222 is retained on the stem 208 via the small diameter end 226 wrapped around the shaft portion 212. Preferably the rib 230 around the shaft portion 212 prevents the end 226 from sliding off the end of the stem 208.

Various modifications and alternatives to the disclosed embodiment will be apparent to those skilled in the art. For example, the spring 222 may be fastened to the shaft portion 212 via a different means than the small diameter end 226 being wrapped around the shaft portion 212. The small diameter end 226 may include a straight portion that fits within a cross bore in the shaft portion 212. The small diameter end 226 could alternatively be fastened to the yoke 202. The head portion 210 of the stem 208 may be rigidly or loosely attached to the yoke 202 via the shaft portion 212 passing through the bore 214. The stem 208 may have any cross sectional shape, such as cylindrical, square, multi-sided, or circular or triangular, and the head portion 210 may have a different shape than that of the shaft portion 212. These are only exemplary variations. Accordingly, all such alternatives, variations and modifications are intended to be encompassed within the scope of and as defined by the following claims.

What is claimed is:

1. A pulley assembly for removably fastening an exercise cord to an exercise apparatus, the pulley assembly comprising: a yoke having a central portion and a pair of parallel leg portions, the central portion having a bore therethrough; a pulley wheel rotatably supported between the yoke leg portions by an axle; an elongated stem having an axially extending shaft portion protruding through the bore, the shaft portion having a distal end portion having an L shaped slot formed therethrough wherein the slot has an axial portion and a radial portion, the radial portion opening through the side of the shaft portion, the axial portion terminating short of the end of the shaft portion, the slot forming a hook shaped end to the shaft portion; a tapered coil spring over the shaft portion of the stem having a small end and a large diameter end, wherein the small end is wrapped around the shaft portion of the stem; and wherein the hook can move within the spring to fasten the pulley to the exercise apparatus.

2. The assembly according to claim 1 further comprising an annular bushing captured in the large diameter end of the coil spring.

3. The assembly according to claim 1 wherein the stem further comprises a raised annular rib between the yoke and the slot and wherein the small end of the spring is wrapped around the stem between the yoke and the raised annular rib on the stem.

4. The assembly according to claim 2 wherein the bushing has an annular peripheral groove receiving the large diameter end of the coil spring.

5. In a reformer exercise apparatus having a generally rectangular frame, a pair of parallel tracks, a carriage movably mounted on the tracks for movement toward and away from a foot end of the frame, and one or more elastic members biasing the carriage toward the foot end of the frame, and a trapeze assembly fastened to a head end of the frame, a pulley assembly removably fastened to one of a plurality of eyebolts mounted to the trapeze assembly, the pulley assembly comprising: a yoke having a central portion and a pair of parallel leg portions, the central portion having a bore therethrough; a pulley wheel rotatably supported between the yoke leg portions by an axle; an elongated stem having an axially extending shaft portion protruding through the bore, the shaft portion having a distal end portion having an L shaped slot formed therethrough wherein the slot has an axial portion and a radial portion, the radial portion opening through the side of the shaft portion, the axial portion terminating short of the end of the shaft portion, the slot forming a hook shaped end to the shaft portion; a tapered coil spring over the shaft portion of the stem having a small end and a large diameter end, wherein the small end is wrapped around the shaft portion of the stem; and wherein the hook can move within the spring to fasten the pulley to the exercise apparatus.

6. The assembly according to claim 5 further comprising an annular bushing captured in the large diameter end of the coil spring.

7. The assembly according to claim 5 wherein the stem further comprises a raised annular rib between the yoke and the slot and wherein the small end of the spring is wrapped around the stem between the yoke and the raised annular rib on the stem.

8. The assembly according to claim 6 wherein the Bushing has an annular peripheral groove receiving the large diameter end of the coil spring.

* * * * *